US007442037B2

(12) United States Patent
Shibamura et al.

(10) Patent No.: US 7,442,037 B2
(45) Date of Patent: Oct. 28, 2008

(54) REFLOW FURNACE

(75) Inventors: Motomu Shibamura, Tokyo (JP); Atsushi Tanaka, Tokyo (JP)

(73) Assignee: Tamura Furukawa Machinery Corporation, Sayama-shi (JP)

( * ) Notice: Subject to any disclaimer, the term of this patent is extended or adjusted under 35 U.S.C. 154(b) by 78 days.

(21) Appl. No.: 11/476,874

(22) Filed: Jun. 29, 2006

(65) Prior Publication Data

US 2007/0042313 A1 Feb. 22, 2007

(30) Foreign Application Priority Data

Jun. 30, 2005 (JP) ..... 2005-192709

(51) Int. Cl.
*F27B 9/10* (2006.01)

(52) U.S. Cl. ..... 432/128; 219/388; 219/394

(58) Field of Classification Search ..... 432/128, 432/133; 219/227, 388; 228/203, 228
See application file for complete search history.

(56) References Cited

U.S. PATENT DOCUMENTS 6,146,448 A * 11/2000 Shaw et al. ..... 95/287
6,386,422 B1 * 5/2002 Cheng et al. ..... 228/46
6,576,030 B2 * 6/2003 Mullins ..... 55/385.1
6,694,637 B2 * 2/2004 Miller et al. ..... 34/82
6,780,225 B2 * 8/2004 Shaw et al. ..... 95/273
2004/0063058 A1 * 4/2004 Orbeck et al. ..... 432/128

FOREIGN PATENT DOCUMENTS

JP 2001-308512 11/2001
JP 2003-324272 11/2003
JP 2004-181483 7/2004

OTHER PUBLICATIONS

U.S. Appl. No. 11/476,874, filed Jun. 29, 2006, Shibamura et al.
U.S. Appl. No. 11/476,851, filed Jun. 29, 2006, Shibamura et al.

* cited by examiner

*Primary Examiner*—Gregory A Wilson
(74) *Attorney, Agent, or Firm*—Oblon, Spivak, McClelland, Maier & Neustadt, P.C.

(57) ABSTRACT

In the first buffering area provided between the inlet of the furnace and the heating chamber, the ambient gas is blown to the printed circuit board from the lower side of the carrier device, while the ambient gas is sucked in the upper side of the carrier device, thus the outside air is prevented from infiltrating and the ambient gas is prevented from flowing out. Furthermore, the flux is prevented from being attached to the printed circuit board, by installing the flux dropping prevention mechanism in the suction port of the ambient gas.

12 Claims, 12 Drawing Sheets

RELATED ART

RELATED ART

RELATED ART

RELATED ART

REFLOW FURNACE

TECHNICAL FIELD

The present invention relates to a reflow furnace in which a printed circuit board mounting electronic components is heated and soldered in inert gas such as nitrogen or the like. Inert gas such as nitrogen or the like is referred to as ambient gas.

RELATED ARTS

Recently, SMDs (Surface Mounted Devices) in which various electronic components are mounted on a surface of a printed circuit board and soldered, have been widely used for electronics devices. As a manufacturing method of this SMD, the following two methods have been developed: a flow soldering process in which electronic components are inserted into a printed circuit board and then the back side is dipped and soldered, and a reflow soldering process in which surface-mounted components are mounted on a circuit board with a cream solder printed and then heated in a heating device calling a reflow furnace to melt cream solder.

A cream solder is a material used when mounting surface-mounted components on a printed circuit board. Solder particles are kneaded with solvent and a catalyzer calling a flux to turn into a material in a creamy manner. A flux included in a cream solder is vaporized and filled in a furnace when solder is melted. In order to prevent this flux from being liquefied and solidified to be stuck on a printed circuit board as a product, flux in the ambient gas is removed by installing a flux collection system.

A reflow furnace is a heating furnace in which while a printed circuit board on which electronic components were mounted is transferred therein through a carrier device composing of a chain conveyor, a printed circuit board and electronic components are soldered by heating such as blowing hot air to melt the solder.

Hereinafter, a heating device for a printed circuit board is referred to as a reflow furnace or simply furnace.

A reflow furnace has two types of furnaces: an atmospheric furnace in which outside air is allowed to enter therein, and a nitrogen reflow furnace in which inert gas such as nitrogen or the like is filled to protect ambient air from entering to improve solder wettability (i.e., melt state). The present invention relates to mainly this nitrogen reflow furnace, more particularly a collection system for collecting a flux in ambient gas and a system for preventing outside air from entering in a furnace inlet and outlet. The background art relating to a nitrogen reflow furnace according to an embodiment of the present invention is hereinafter described.

First, a configuration of a reflow furnace according to the present invention is described with reference to the drawing (FIG. 9) of the patent document 1 (Japanese Patent Application Publication No. 2001-308512). A reflow furnace 101 is provided with five heating zones 102 and 103 and one cooling zone 104. Number of these heating zones and cooling zones varies depending on a type of a reflow furnace.

The furnace is provided with a rail-interval variable carrying rail (not illustrated), on which a plurality of printed circuit boards are transferred sequentially from the furnace inlet to the furnace outlet in the arrow A direction shown in FIG. 9 on a chain conveyor in the furnace. Interval of the rail-interval variable carrying rail is adjusted according to the size of the printed circuit board.

The inlet and outlet of the reflow furnace is provided with an air flow-prevention device called a Labyrinth 110 schematically shown in FIG. 9. The Labyrinth comprises a plurality of fin-shaped metal plates and the like, in which the shape of these metal plates generates a swirling current of the air to prevent outside air from entering.

Among the,heating zones, first 3 zones are called a preheating zone 102, in which a flux included in cream solder is sufficiently activated. After that, in a peak heating zone 103 in which solder is melted, a printed circuit board is heated to the predetermined temperature. After solder is melted, the printed circuit board is cooled in a cooling zone 104 and then carried out.

As described above, the inlet and outlet of the reflow furnace is provided with an air flow-prevention device called the Labyrinth to prevent outside air from entering the reflow furnace. However, since printed circuit boards being transferred on the carrying rail are in sequence from the inlet, it is difficult to prevent outside air from entering perfectly. Accordingly, designing pressure of ambient gas in the furnace to be higher than outside atmospheric pressure causes gas in the vicinity of the Labyrinth to flow from the inside to the outside of the furnace.

Meanwhile, since nitrogen gas used as ambient gas is included in a cost of manufacturing, it is required that consumption of this nitrogen gas is reduced in order to lower the cost of manufacturing.

In addition, temperature control of the ambient gas in each zone becomes an important element to maintain the quality of the product. Accordingly, it is necessary to prevent outside air from entering and ambient gas from transferring between each zone as a factor as much as possible to disturb temperature control in each zone.

A method for heating a printed circuit board in this reflow furnace is described with reference of FIG. 10. FIG. 10 is a Y-Y line sectional view of FIG. 9. A printed circuit board 106 is transferred on the carrier device 105 in the direction passing through the paper from the front of the paper. The ambient gas in the furnace is sucked from the upper both sides by a circulation fan 108 driven by a fan motor 109 and blown down. During this suction process, the ambient gas is heated by an electric heater 115. The printed circuit board 106 is heated by heated ambient gas and an infrared panel heater 125.

The infrared panel heater 125 is provided under the printed circuit board 106 to heat the bottom side of the printed circuit board at the same time.

The ambient heating the printed circuit board is heated by an electric heater 115, and then sucked by the circulation fan 108 to be flown downward again. New ambient gas is supplied through an enclosing port (not shown) to maintain a pressure of the ambient gas within the furnace at a specific value, thus preventing the outside air from entering the reflow furnace.

Recently, a solder containing no lead (hereinafter referred to as "lead free solder") becomes mainstream from the point of environment harmonization product development. Since the lead free solder has a high melting point of about 220 degrees Celsius, it is necessary to control the temperature of heating the printed circuit board within a range of about 230 to 240 degrees Celsius.

On the other hand, some of the electric components has a low heat resistance, and is damaged to lose reliability when heated at least 240 degrees Celsius. The temperature control to heat the printed circuit board within the reflow furnace therefore becomes further strict by applying the lead free solder.

Accordingly, there is a tendency to avoid a heating method by an infra-red radiation which is difficult in the temperature control, while there is a tendency to apply a hot-air type in which the printed circuit board is heated from both of the lower side and the upper side by the hot air heated to a specific temperature. In general, the type to heat the printed circuit board by blowing hot air is called as a collision jet flow type, which has a high heat transfer coefficient and is excellent in heating capability.

In the recent reflow furnace to which a precise temperature control within the furnace is required, the infiltration of the outside air from the inlet and the outlet of the furnace causes a serious problem in the temperature within the furnace, thus it is necessary to prevent the outside air infiltration as far as possible. Furthermore, a sensitive temperature control of the ambient gas within each zone is required, and it is necessary to prevent the ambient gas from moving between the zones.

The following conventional technique to prevent the outside air from infiltrating at the inlet and the outlet of carrier device of the printed circuit boards are known:

(1) closing the opening portion of the inlet and outlet of the furnace by a cover made of flexible material;
(2) providing a movable shutter to close same except that the printed circuit board passes;
(3) providing a labyrinth at the inlet and outlet of the furnace;
(4) providing a nozzle device to blow the ambient gas outward in the vicinity of the inlet and outlet of the furnace; and
(5) causing the position of the labyrinth to move upward and downward according to the kind of the printed circuit board to reduce a gap.

The above described conventional technique have the following problems:

(1) When the opening portion is closed by the flexible cover, the cover may contact with the printed circuit board when the printed circuit board passes. When the cover is smeared by the flux generated within the furnace, the printed circuit board is contaminated by the contact with the cover.
(2) Since the movable shutter has a complex construction, the flux is attached to the shutter to cause the shutter to fail moving. The frequent entries and outings of the printed circuit boards change the closing function not to maintain a desirable temperature and oxygen concentration within the furnace.
(3) Although the labyrinth is effective to solve the above described problems (1) and (2), the length of the furnace becomes long if it is required to obtain enough function by the labyrinth per se.
(4) The method to blow the ambient gas outward in the vicinity of the inlet and outlet of the furnace cause expensive ambient gas (for example nitrogen gas or the like) to directly flow out of the furnace, thus the manufacturing cost becomes expensive.

The conventional technique described above in item (5) in which the position of the labyrinth is caused to move upward and downward according to the kind of the printed circuit board is explained with reference to the figure (FIG. 12) of the patent document (Japanese patent application publication No. 2004-181483.

However, even if the above apparatus is used, there remains a gap between the printed circuit board and the inlet of the furnace, thus it is difficult to prevent the ambient gas from flowing out or the outside gas from infiltrating. Furthermore, the installation becomes a large scale.

Inevitable element is the collection of the flux when considering the apparatus of preventing the outside air from infiltrating in the reflow furnace. Cream solder is used in the printed circuit board. The cream solder is a cream type substance made of particles of solder kneaded with solvent and catalyst called as flux.

The cream solder in the printed circuit board heated in the heating zone of the reflow furnace is melt within the furnace to be soldered. At this moment, the flux is evaporated and filled within the furnace. The high temperature ambient gas containing flux is contacted with the outside air and the temperature thereof is lowered to be liquefied or solidified. When the liquefied or solidified flux is attached to the printed circuit board, the quality of the printed circuit board is deteriorated.

Although it depends on flux composition, the flux in general is in a paste state, and when heated, the flux is liquefied at the temperature of about 70 degrees Celsius. When further heated, the flux is remarkably vaporized at the temperature of about 170 degrees Celsius.

On the other hand, the flux vaporized within the furnace is liquefied as the temperature thereof is lowered. The temperature of being liquefied is different depending on the kind, i.e., solvent flux or rosin flux.

When the temperature of the ambient gas is lowered, the rosin flux starts to be liquefied at the temperature of 180 to 150 degrees Celsius. When the temperature of the ambient gas is further lowered, the rosin flux starts to be solidified at the temperature of 100 degree Celsius. When the temperature of the ambient gas is further lowered, then the solvent flux is liquefied at the temperature of about 70 degrees Celsius. More specifically, the rosin flux is liquefied at the temperature of about 170 degrees Celsius, while the solvent flux is liquefied at the temperature of about 70 degrees Celsius.

The temperature of the ambient gas in the initial preheating zone in there flow furnace is often set to be about 170 degrees Celsius. When the pressure within the furnace is set to be higher than the pressure of the outside air, the ambient gas within the preheating zone flows out to the inlet of the furnace. The solvent and rosin composition of the flux contained in the ambient gas flown out contact with the outside air, and the temperature thereof is lowered to be liquefied and attached to the printed circuit board carried into. How to collect the flux therefore becomes important technical element when preventing the outside air from infiltrating or the ambient gas from flowing out.

Next, the conventional art regarding the flux collection system is described with respect to the drawing (FIG. 11) of the patent document 3 (Japanese Patent Application Publication No. 2003-324272).

As described above, the cream solder is used to load and hold the surface-mounted component on the printed circuit board. The flux contained in the cream solder is melt in the heating chamber of the reflow furnace and then vaporized to fill the furnace. The flux collection device is provided in the reflwo furnace to prevent the flux from attaching to the printed circuit board.

FIG. 11 is a sectional view showing a heating chamber of the reflow furnace 101. The printed circuit board 106 is transferred on the carrier device 105 in the direction passing through the paper from the front of the paper. The ambient gas in the furnace marked with the arrow is blown down from a mesh body 151 by the circulation fan 108 driven by the fan motor 109 to heat the printed circuit board 106. The ambient gas which heated the printed circuit board is sucked by the circulation fan 108, is heated by the electric heater 115 and is blown downward again from the both sides.

Meanwhile, some part of the ambient gas blown from the circulation fan 108 is fed to a flux collection system 153 illustrated on the right side of the drawing. The ambient gas cooled by an inside heat exchanger 175 comes in contact with an outside air heat exchanger 163 cooled by an outside air fan 169, causing the flux to be liquefied.

The liquefied flux is collected by a storage tank 173. The ambient gas whose flux component was removed is returned to the heating chamber again and is heated by the electric heater 115.

The above-mentioned flux collection system is only one example and flux collection systems having various configurations have been used actually. However, all types employ the configuration to let ambient gas come in contact with the cooled heat exchanger to liquefy and collect the flux.

As described above, a lead free solder of environment harmonization comes to be often used. However, even though the lead free solder has a high melting point, the heat resistance temperature of the electronic component does not change, thus the strict temperature control is required in the heating in the reflow furnace.

On the other hand, in order to prevent a printed circuit board from being deteriorated due to oxidation during soldering work to ensure the high reliability of the printed circuit board, number of users who are desired to solder at low oxygen concentration is growing. However, due to furnace configuration limitations, outside air cannot not be prevented from entering from the inlet or outlet of the furnace. Accordingly, in order to achieve the low oxygen concentration in the furnace, it is necessary to constantly put a plenty of ambient gas (nitrogen or the like) into the furnace. However, from a manufacturing cost standpoint, consumption of this ambient gas cannot be neglected. As described above, conventional reflow furnaces have a technical problem in that consumption of nitrogen must be reduced while the predetermined solder melting temperature is achieved at low oxygen concentration.

Furthermore, in the inlet and outlet, the border portion between the heating zone and the cooling zone within the furnace, the temperature of the ambient gas drastically varies, thus the flux filled in the ambient gas is liquefied or solidified to be attached to the printed circuit board to deteriorate the quality of the printed circuit board. It is therefore necessary to prevent the flux from being attached to the printed circuit board in the outside air infiltration prevention device, the ambient gas movement within the furnace prevention device and the ambient gas flowing-out prevention device.

The inventors have repeated studies and experiments. As a result, the ambient gas is prevented from flowing out of the furnace, the outside air prevented from infiltrating, and the flux is removed according to the various means described hereunder.

SUMMARY OF THE INVENTION

A first embodiment of the reflow furnace of the invention comprises: a plurality of heating chambers to heat by blowing a heated ambient gas to a printed circuit boards carried within the furnace by a carrier device; a cooling chamber provided next to said heating chamber to cool said printed circuit boards; a first buffering area provided between said heating chamber and an inlet of the reflow furnace; a blowing device to blow the ambient gas from a lower side of the carrier device to an upper side thereof in said first buffering area; a suction device with a flux dropping-prevention mechanism to suck the ambient gas above the carrier device in said first buffering area; and a flux collection unit to remove the flux from the sucked ambient gas.

A second embodiment of the reflow furnace of the invention comprises: a plurality of heating chambers to heat by blowing a heated ambient gas to a printed circuit boards carried within the furnace by a carrier device; a cooling chamber provided next to said heating chamber to cool said printed circuit boards; a second buffering area provided between said cooling chamber and an outlet of the reflow furnace; a blowing device to blow the ambient gas from a lower side of the carrier device to an upper side thereof in said second buffering area; a suction device with a flux dropping-prevention mechanism to suck the ambient gas above the carrier device in said second buffering area; and a flux collection unit to remove the flux from the sucked ambient gas.

A third embodiment of the reflow furnace of the invention comprises: a plurality of heating chambers to heat by blowing a heated ambient gas to a printed circuit boards carried within the furnace by a carrier device; a cooling chamber provided next to said heating chamber to cool said printed circuit boards; a third buffering area provided between said heating chamber and said cooling chamber; a blowing device to blow the ambient gas from a lower side of the carrier device to an upper side thereof in said third buffering area; a suction device with a flux dropping-prevention mechanism to suck the ambient gas above the carrier device in said third buffering area; and a flux collection unit to remove the flux from the sucked ambient gas.

A fourth embodiment of the reflow furnace of the invention further comprises: a second buffering area provided between said cooling chamber and said outlet of the reflow furnace; a blowing device to blow the ambient gas from a lower side of the carrier device to an upper side thereof in said second buffering area; a suction device with a flux dropping-prevention mechanism to suck the ambient gas above the carrier device in said second buffering area; and a flux collection unit to remove the flux from the sucked ambient gas.

A fifth embodiment of the reflow furnace of the invention further comprises: a third buffering area provided between said heating chamber and said cooling chamber; a blowing device to blow the ambient gas from a lower side of the carrier device to an upper side thereof in said third buffering area; a suction device with a flux dropping-prevention mechanism to suck the ambient gas above the carrier device in said third buffering area; and a flux collection unit to remove the flux from the sucked ambient gas.

A sixth embodiment of the reflow furnace of the invention further comprises: a third buffering area provided between said heating chamber and said cooling chamber; a blowing device to blow the ambient gas from a lower side of the carrier device to an upper side thereof in said third buffering area; a suction device with a flux dropping-prevention mechanism to suck the ambient gas above the carrier device in said third buffering area; and a flux collection unit to remove the flux from the sucked ambient gas.

In a seventh embodiment of the reflow furnace of the invention, said flux dropping-prevention mechanism includes a umbrella-shaped cover portion and a trough portion provided at a lower portion of an inner wall of said cover portion.

In an eighth embodiment of the reflow furnace of the invention, said flux dropping-prevention mechanism includes a umbrella-shaped cover portion and a flocculent flux adsorption plate provided at a lower portion of an inner wall of said cover portion.

In a ninth embodiment of the reflow furnace of the invention, said flux dropping-prevention mechanism includes a heater and a mesh plate heated by said heater.

In a tenth embodiment of the reflow furnace of the invention, said flux collection unit includes a circulation fan, an outside air fan, a heat exchanger, and a liquefied flux collection tank.

An eleventh embodiment of the reflow furnace of the invention further includes a labyrinth provided at an inlet or outlet thereof.

In a twelfth embodiment of the reflow furnace of the invention, said ambient gas comprises an inert gas such as nitrogen or the like, and said ambient gas is filled within the reflow furnace.

DETAILED DESCRIPTION OF THE INVENTION

The embodiments of the present invention are described hereinafter in detail with reference to the accompanying drawings.

First Embodiment

Figure 1:
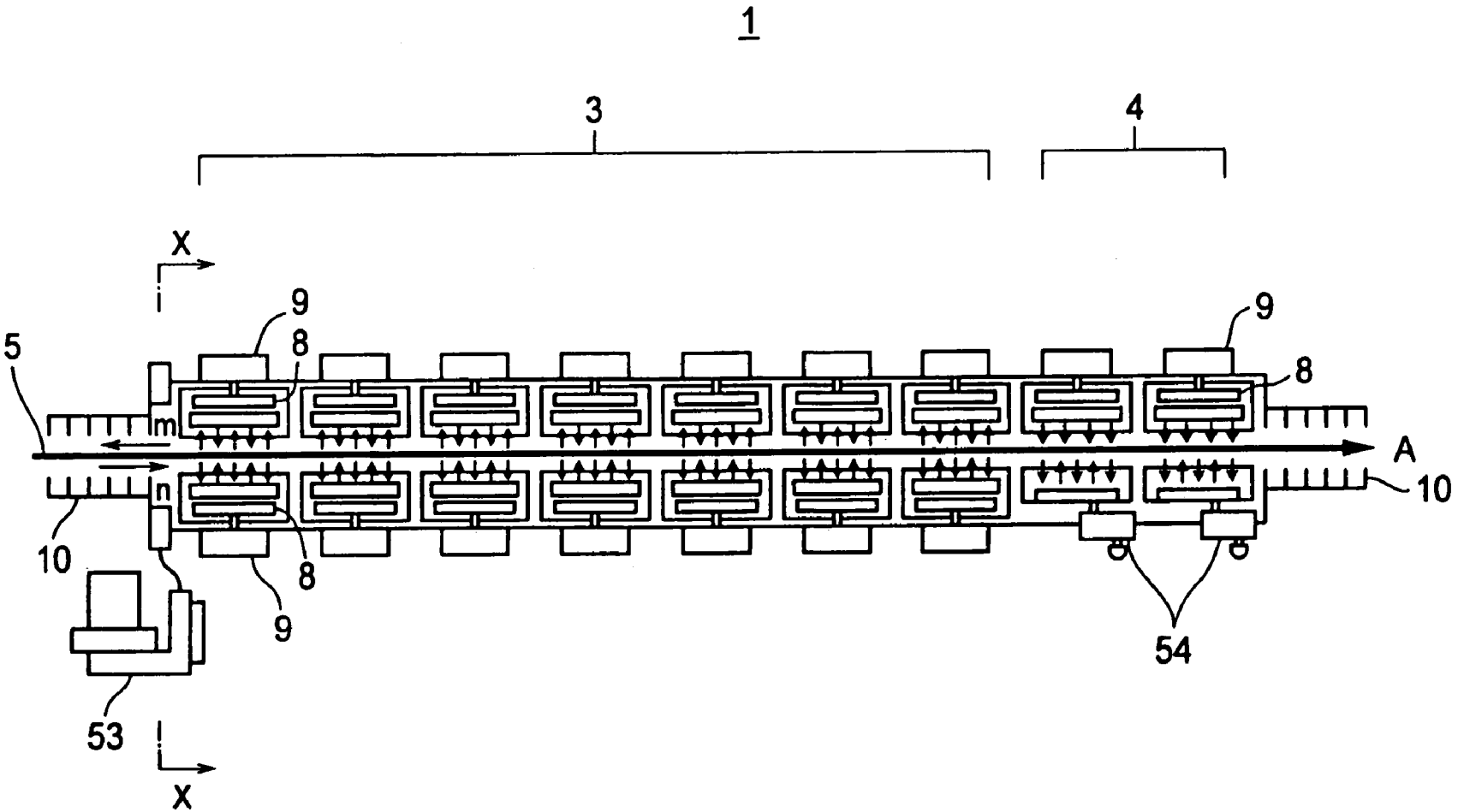
FIG. 1 is an overall view showing a reflow furnace according to the first embodiment of the present invention.

FIG. 1 is an overall view showing an entire configuration of a nitrogen reflow furnace 1 according to the first embodiment of the present invention. A plurality of printed circuit boards (not illustrated) mounted on a carrier device 5 are transferred from an inlet on the left of the drawing toward an outlet on the right side of the drawing in the arrow A direction.

A device called as labyrinth 10 which prevents infiltration of the outside air is provided the inlet side and/or the outlet side of the reflow furnace to prevent outside air from entering at the inlet side and outlet side of the furnace. However, it is impossible to completely prevent the outside air from entering, since the printed circuit boards are sequentially transferred on the carrier line, as described above.

A reflow furnace shown in FIG. 1 is provided with a heating zone 3 and a cooling zone 4. The heating zone comprises 7 heating chambers and the cooling zone comprises 2 cooling chambers. In this furnace, the first 4 heating chambers are designed to be a preheating zone and the next 3 heating chambers are designed to be a peak heating zone. In these peak heating zones, cream solder on the printed circuit board is melted. After solder is melted, the printed circuit board is transferred to the cooling zone, cooled and then carried out of the furnace.

The number of the heating zone and cooling zone varies depending on the kind of the reflow furnace, in addition, the numbers of the preheating zone as well as the peak heating zone in the heating zone are varied.

Figure 10:
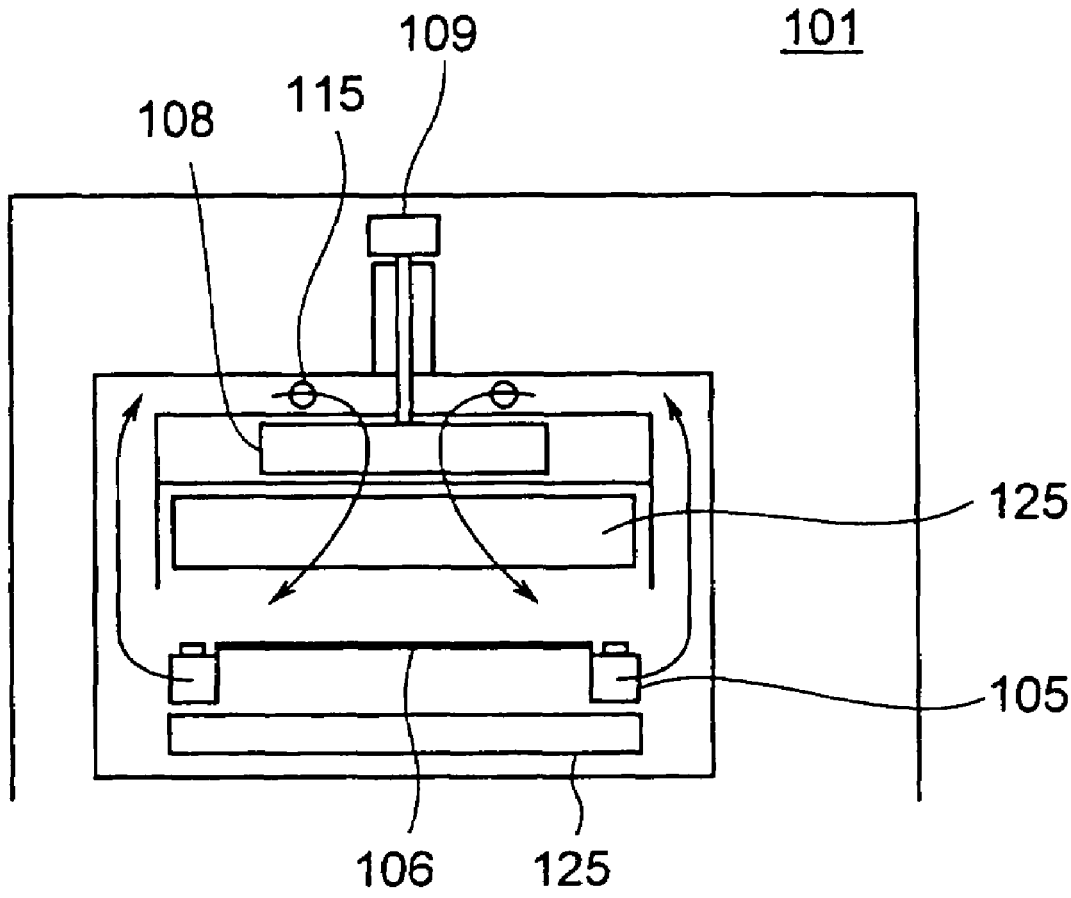
FIG. 10 is a sectional view of a reflow furnace according to the conventional art.
Figure 11:
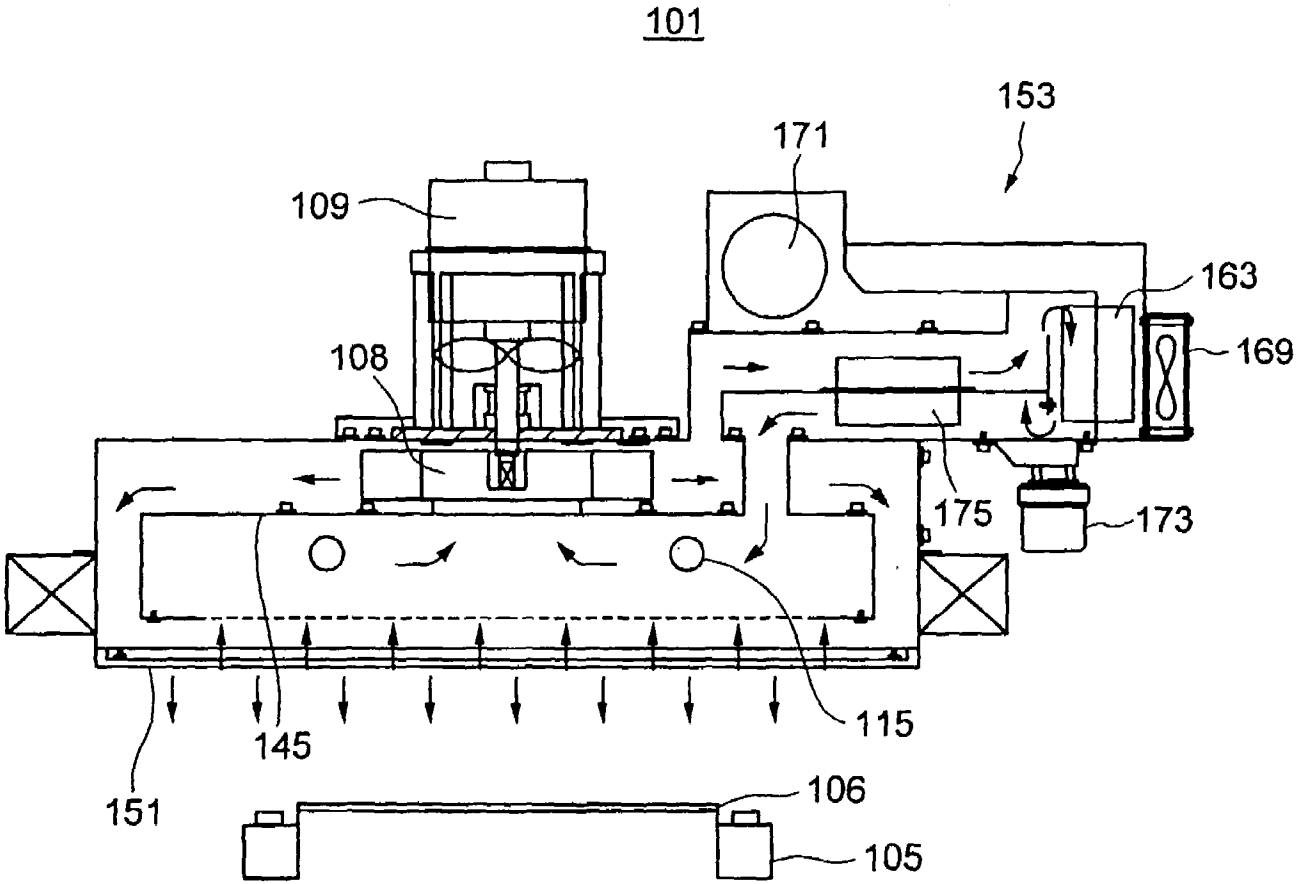
FIG. 11 is a view showing a configuration of the flux collection device according to the conventional art.
Figure 12:
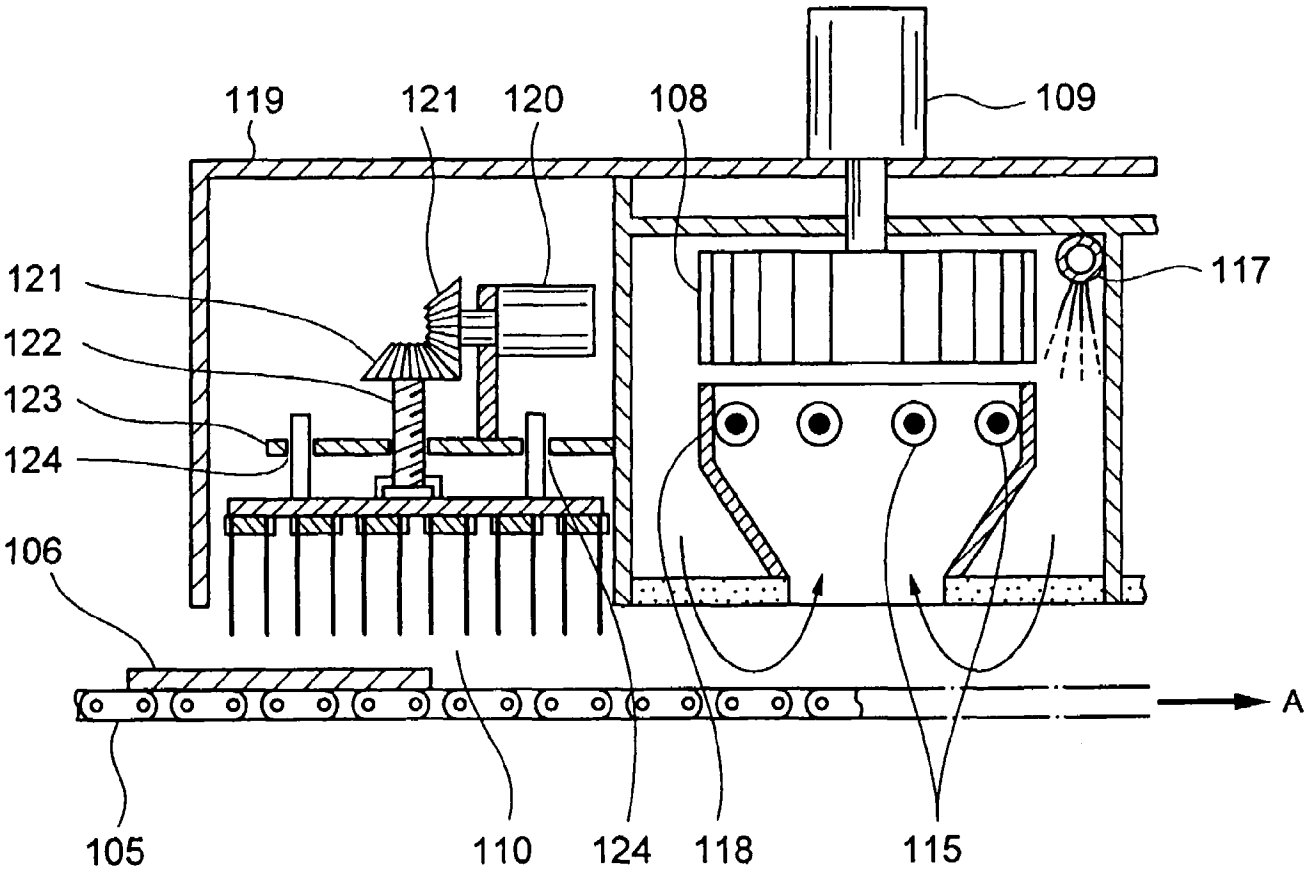
FIG. 12 is a view showing a configuration of an outside air infiltration preventive device according to the conventional art.

The printed circuit board is heated in each heating chamber based on the heating method described above while referring to FIG. 10. There flow furnace according to the present invention is provided with the hot air blowing mechanism in the lower side having the same configuration as installed in the upper side of FIG. 10. The above appearance is schematically shown in each heating chamber of FIG. 1.

The circulation fan 8 driven by the fan motor 9 is arranged at the upper side and the lower side of the heating chamber, and a cool air blowing device is arranged only at the upper side of the cooling chamber to lower the room temperature. The flux collection device 54 is arranged in the cooling chamber to liquidize the flux in the ambient gas and collect same, thus preventing the flux from attaching to the printed circuit board.

An inlet and outlet of the reflow furnace are provided with an opening to allow printed circuit boards to enter and exit. Release of ambient gas release and entry of outside air are generated from this opening.

Since releasing ambient gas is heated at 100 or more degree Celsius, it flows and releases on the upper side of the carrier device 5 as shown by the arrow m at the inlet in FIG. 1. Meanwhile, in comparison with the furnace-inside gas, outside air at low temperature flows in the lower side of the carrier device 5 as shown by the arrow n.

Accordingly, in order to prevent outside air from entering, it is effective to block the flow of outside air in the lower side of the carrier device 5 and in order to prevent ambient air from releasing from the furnace, it is effective to block the flow of ambient air in the upper side of the carrier device.

The present invention is made as an apparatus to obtain the above-mentioned effect. That is, a first buffering area is provided in the boundary between the Labyrinth 10 and the first heating chamber (hereinafter referred to a preheating chamber) to compose a system to regulate a flow of ambient gas from the lower side to the upper side of the carrier device as serving as an air curtain. Outside air is prevented from entering due to ambient gas blown from the lower side of the carrier device and ambient gas released from the preheating chamber is sucked from the suction device provided on the upper side of the buffering area to prevent it from releasing out of the furnace.

As described above, the ambient gas in the furnace includes vaporized flux to be generated when cream solder of the printed circuit board is melted. For this flux, rosin-based flux is liquefied at about 170 degree Celsius and solvent-based flux is liquefied at about 70 degree Celsius. Since outside air enters the buffering area with printed circuit boards, the temperature of the buffering area is lower than the preheating chamber. Accordingly, the temperature of the ambient gas released from the preheating chamber decreases and the liquefaction of flux starts. When sucking the ambient gas at the upper side of the buffering area, it is necessary to prevent flux from being liquefied and dropping onto a printed circuit board.

Figure 2:
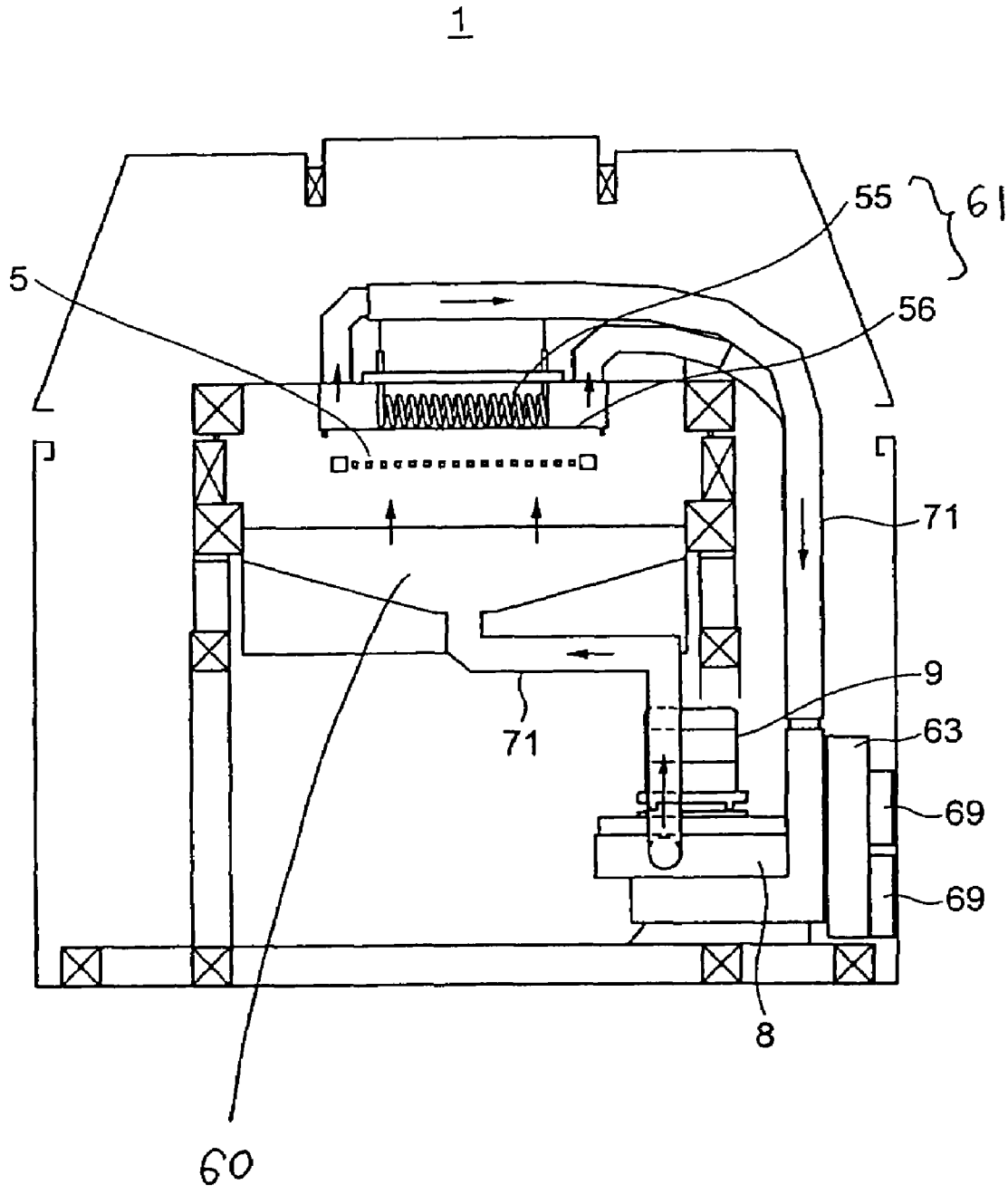
FIG. 2 is a sectional view showing a reflow furnace at the first buffering area according to the first embodiment of the present invention.

FIG. 2 is a X-X line sectional view of FIG. 1. The printed circuit board is transferred on the carrier device 5 in the direction passing through the paper from the front of the paper. Ambient gas is blown from a blowing device 60 as shown by an arrow facing upward from the lower side of the carrier device 5 to protect outside air from entering. An ambient gas suction device 61 having a mesh plate 56 and a heating heater 55 is provided above the carrier device 5.

Figure 3:
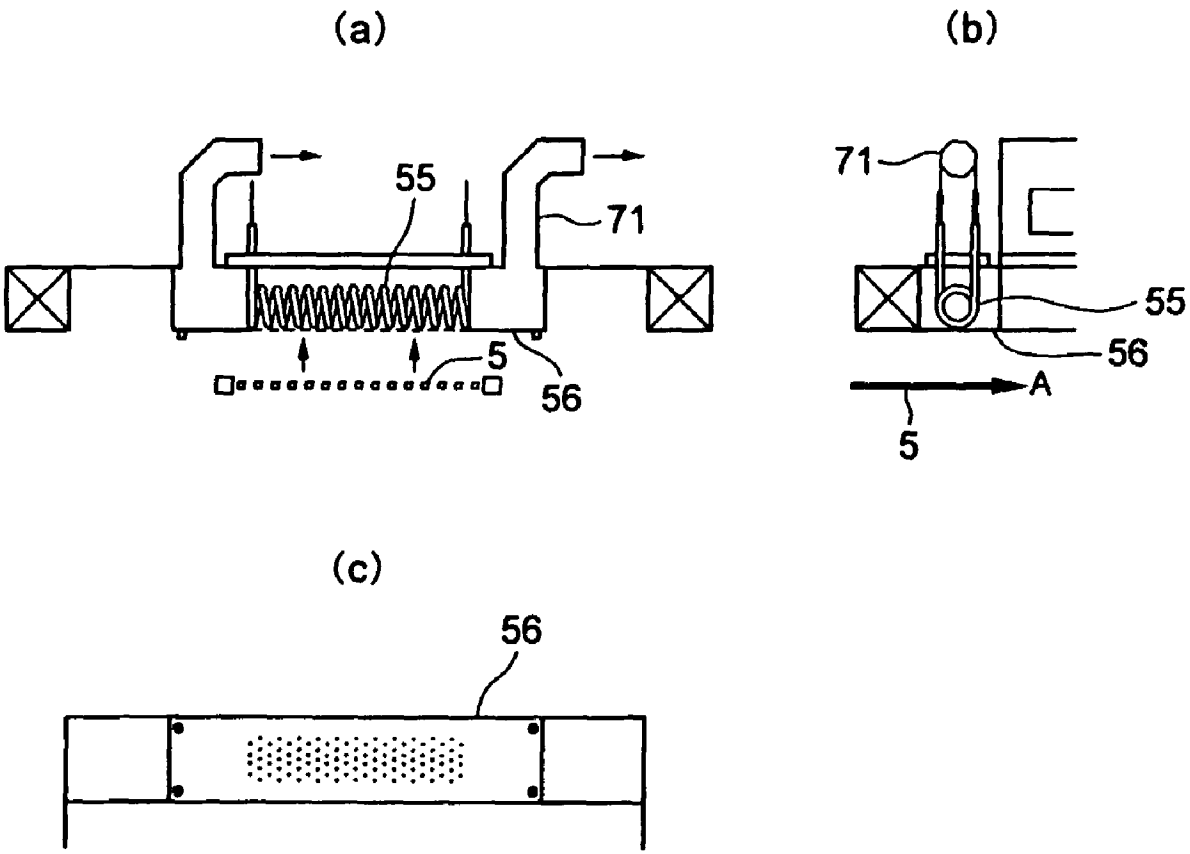
FIG. 3 is a view showing a configuration of a suction port for ambient gas according to the embodiments of the present invention.

FIG. 3(*a*) is an enlarged view showing a suction device for ambient gas and a flux dropping-prevention mechanism. As shown by an arrow facing upward from the lower side of the carrier device 5, ambient gas is blown. The ambient gas is sucked by the mesh plate 56 heated by the heating heater 55 to form a vertical air curtain. The sucked ambient gas is introduced into a flux collection system 53 shown in FIG. 1 by a piping 71.

FIG. 3(*b*) is a side view of this suction device. The printed circuit board is transferred in the arrow A direction by the carrier device 5. FIG. 3(*c*) is a bottom view of this suction device. This mesh plate 56 is heated by the heating heater 55 and ambient gas is passed through this mesh plate and introduced into the piping 71.

The ambient gas heated by the heater 55 as shown in FIG. 2 is introduced to the heat exchanger 63 (shown in FIG. 2) in the flux collection unit. The temperature of the gas is lowered therein, and the flux is liquefied and collected in a liquefied flux collection unit.

The ambient gas with the flux composition removed in the flux collection unit is fed into the piping 71 by the circulation fan 8 driven by the fan motor 9, and discharged from the lower side of the carrier device 5.

As described above, the outside air is prevented from entering by the ambient gas blown from the lower side of the carrier device 5. The ambient gas flown out of the preheating chamber is sucked upward by the suction device provided in the upper portion of the buffering area. Thus the ambient gas is prevented from flowing out of the reflow furnace. Furthermore, the ambient gas is heated by the heater 55 to prevent the flux from being liquefied and dropped onto the printed circuit board.

Second Embodiment

Figure 4:
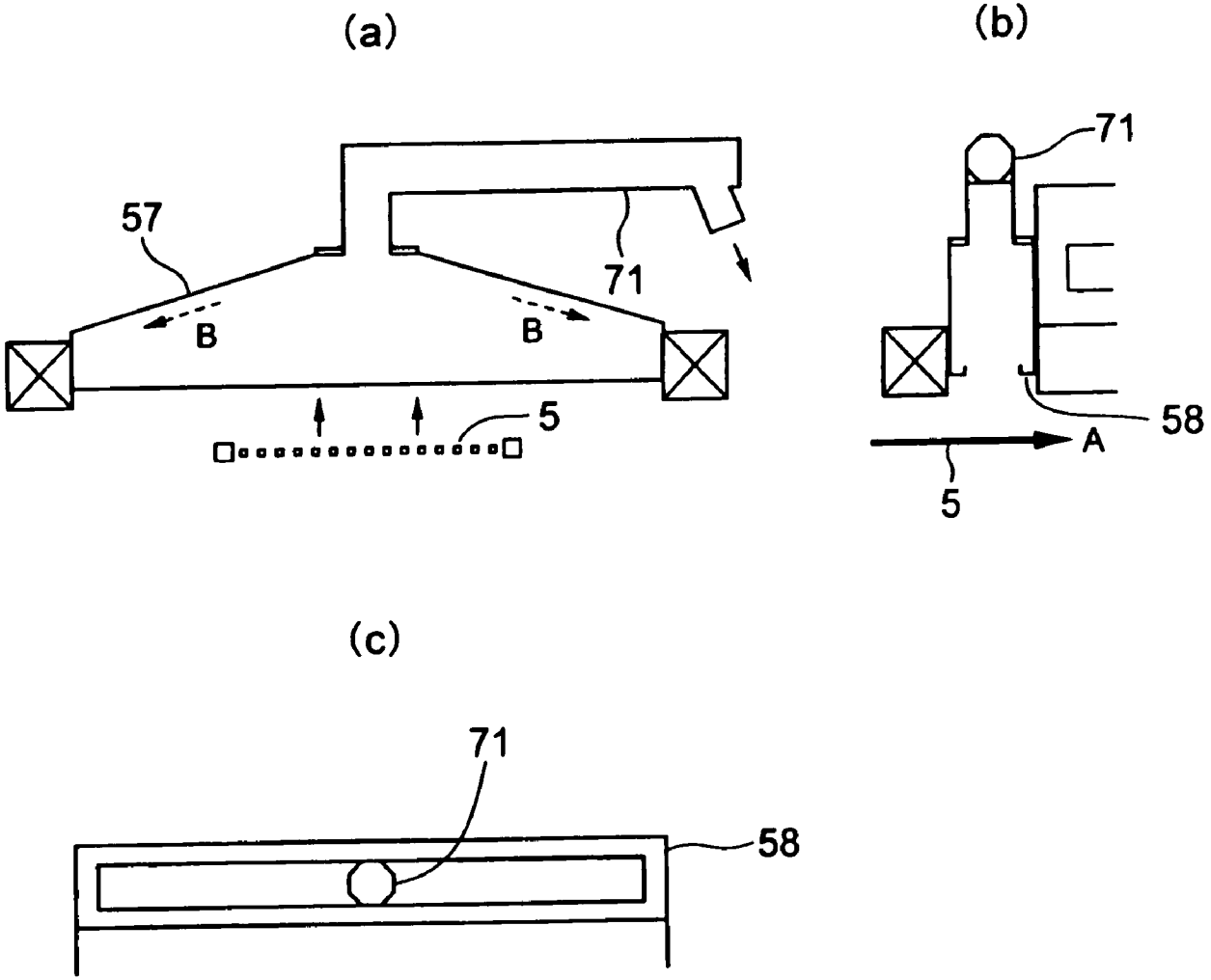
FIG. 4 is a view showing a configuration of a suction port for ambient gas according to the second embodiment of the present invention.

FIG. 4 shows the second embodiment of the ambient gas suction device and the flux dropping prevention mechanism of the present invention. The ambient gas suction device and the flux dropping preventing mechanism as depicted in FIG. 4A are provided in place of the suction device comprising the mesh plate 56 and the heater 55 as depicted in FIG. 2.

FIG. 4A is a sectional view of the ambient gas suction device and the flux dropping prevention mechanism according to the second embodiment. The printed circuit boards (not shown) are transferred on the carrier device 5 in a direction to pierce the drawing from the front side to the back side. The umbrella shaped cover 57 is provided above the carrier device 5. A discharge route 71 is provided at the top portion of the cover. The cover 57 has slanted surfaces as shown in FIG. 4A. The liquefied flux produced when the ambient gas hits the cover and cooled, flows along the inner wall of the cover as denoted by an arrow B.

FIG. 4B is a side view of the mechanism. The printed circuit boards (not shown) are carried on the carrier device in the direction as denoted by an arrow A. Trough 58 is provided at the respective end portions of the umbrella shaped cover on the carrier device. The liquefied flux flowing down the inner surface of the cover is prevented from dropping on the printed circuit board by the trough. FIG. 4C is a bottom view of the cover.

Third Embodiment

Figure 5:
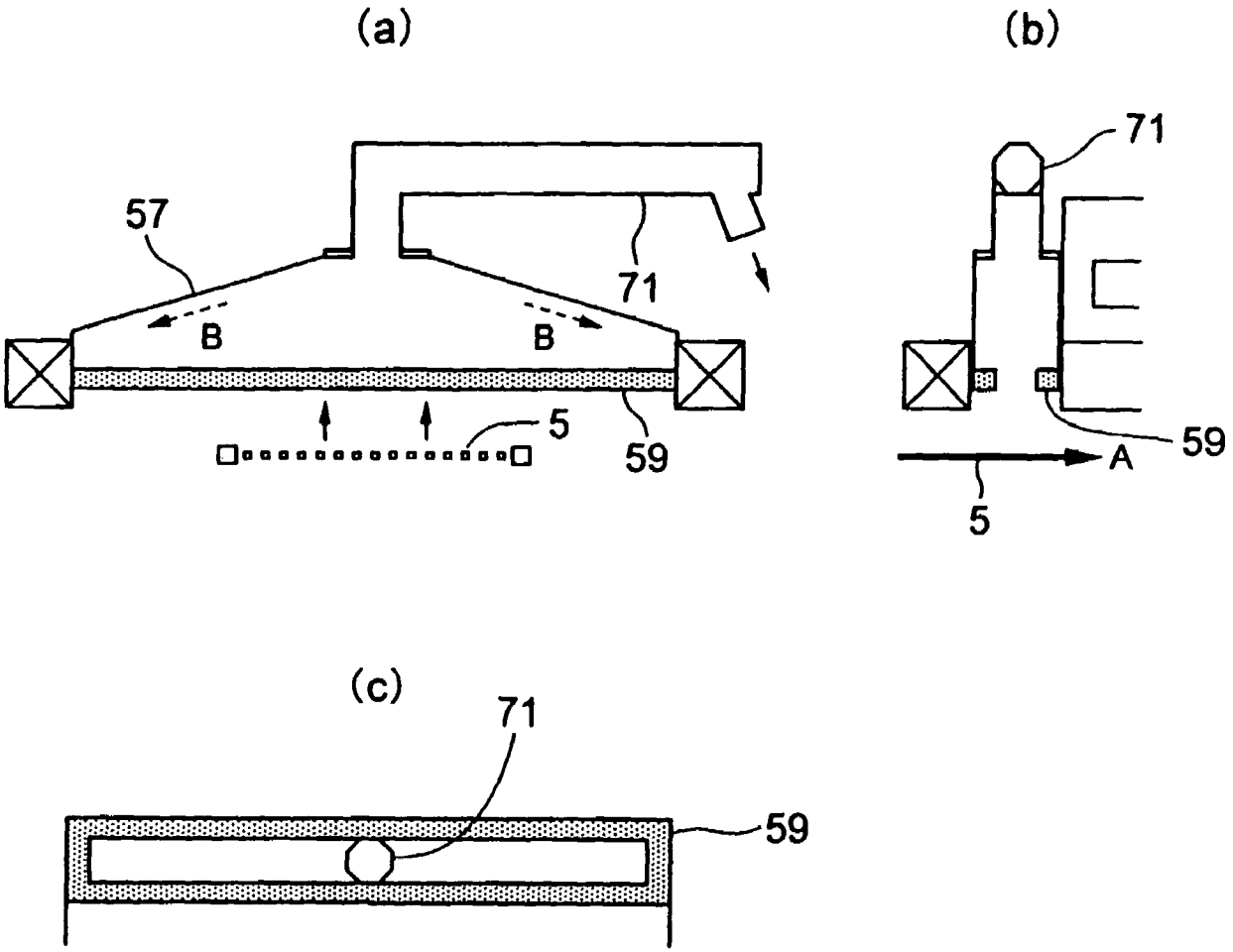
FIG. 5 is a view showing a configuration of a suction port for ambient gas according to the third embodiment of the present invention.

FIG. 5 shows the third embodiment of the invention. The ambient gas suction device and the flux dropping-prevention mechanism as depicted in FIG. 5A is provided in place of the suction device comprising the mesh plate 56 and the heater 55 as depicted in FIG. 2.

FIG. 5A is a sectional view of the ambient gas suction device and the flux dropping prevention mechanism according to the third embodiment. The printed circuit boards (not shown) are transferred on the carrier device 5 in a direction to pierce the drawing from the front side to the back side. The umbrella shaped cover 57 is provided above the carrier device 5. A discharge route 71 is provided at the top portion of the cover. The cover 57 has slanted surfaces as shown in FIG. 4A. The liquefied flux produced when the ambient gas hits the cover and cooled, flows along the inner wall of the cover as denoted by an arrow B. The structure is the same as that of the second embodiment, as described above.

A flocculent flux adsorption plate 59 is provided at the lowest portion of the cover 57. FIG. 5A shows a sectional view of the flux suction device. FIG. 5B shows the side view thereof. FIG. 5C is the bottom view thereof. The ambient gas is sucked through the piping 71. The liquefied flux is prevented from dropping on the printed circuit board 59 by the flocculent flux adsorption plate 59.

The mechanism as described in the first to third embodiments may be provided separately, however, the second embodiment or the third embodiment may be combined with the first embodiment. More specifically, the mesh plate 56 and the heater 55 as depicted in FIG. 3 may be provided together at the lower surface of the umbrella shaped cover. The flocculent flux adsorption plate in the third embodiment may be provided within the trough 58 in the second embodiment.

Fourth Embodiment

Figure 6:
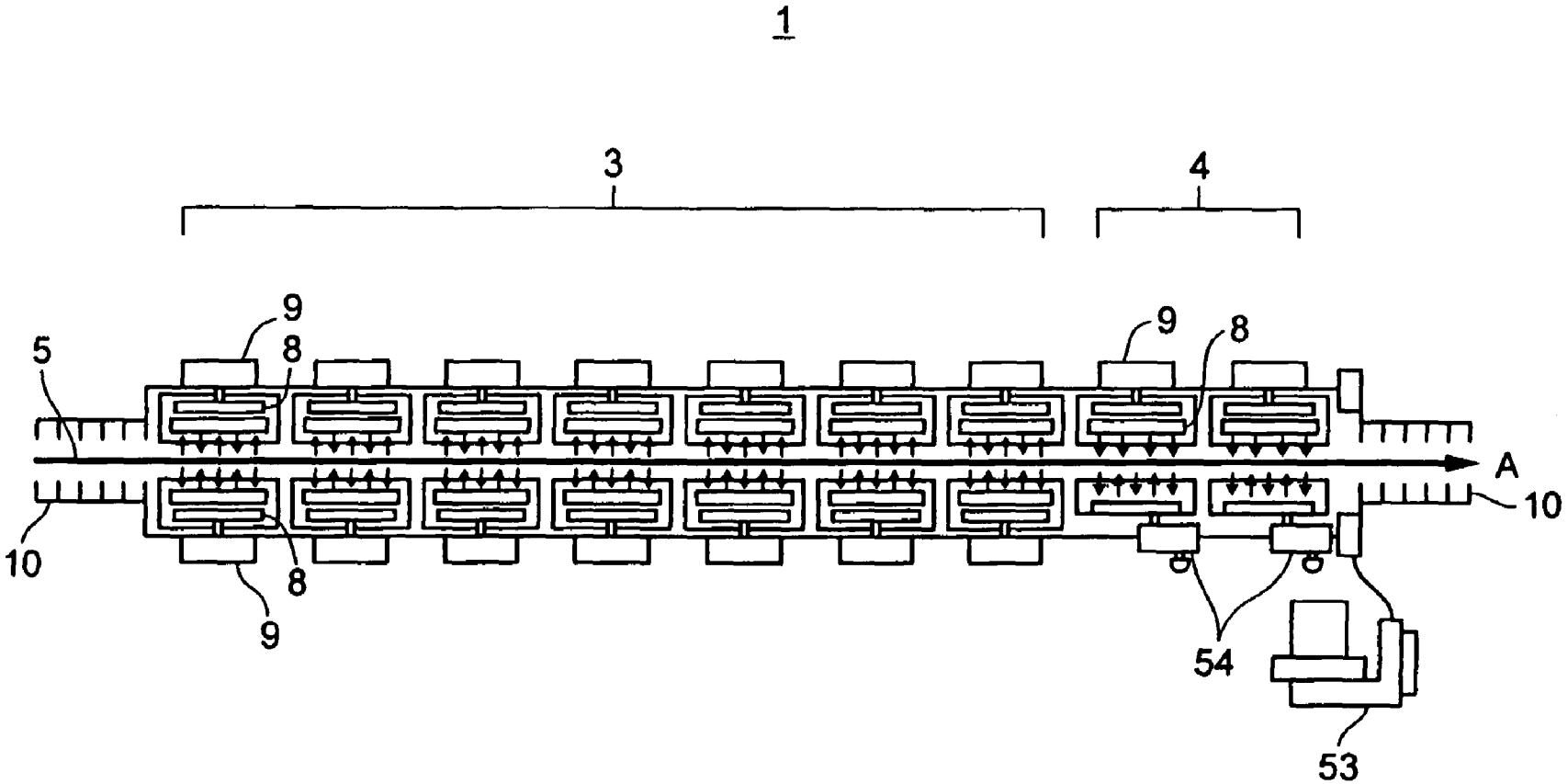
FIG. 6 is an overall view showing a reflow furnace according to the fourth embodiment of the present invention.

FIG. 6 shows a fourth embodiment. As shown in FIG. 6, a second buffering area is provided between the cooling chamber and outlet side labyrinth 10, and the flux collection unit 53 and others are provided.

Since the second buffering area is provided between the cooling chamber and outlet side labyrinth, the ambient gas is prevented from flowing out of the outlet.

In this embodiment, it is necessary to provide the liquefied flux dropping prevention due to the temperature difference between the ambient gas within the cooling chamber and outside air. The ambient gas suction device and the flux dropping prevention mechanism as described in the first to third embodiments may be provided to prevent the flux from being liquefied and dropping.

Fifth Embodiment

Figure 7:
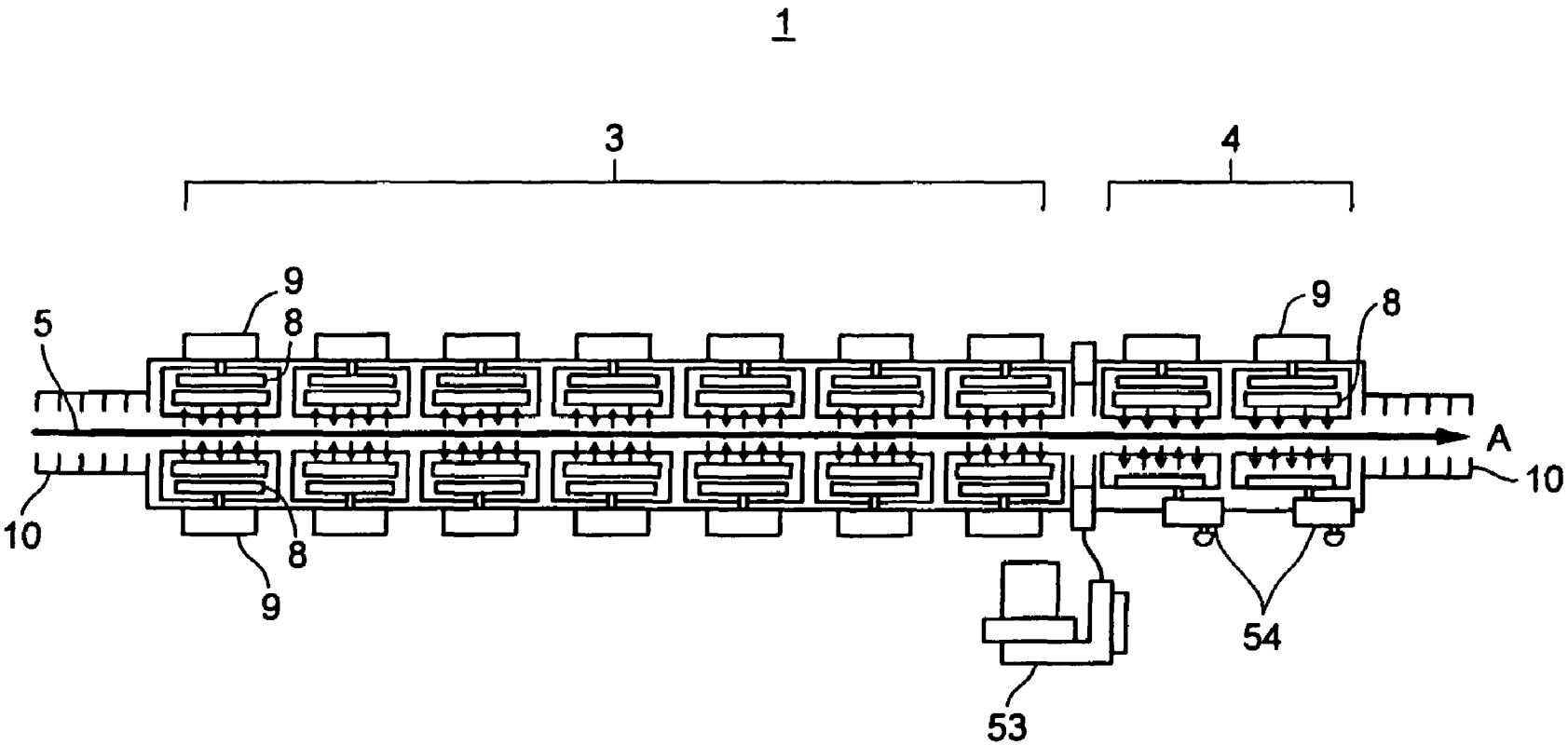
FIG. 7 is an overall view showing a reflow furnace according to the fifth embodiment of the present invention.

FIG. 7 shows a fifth embodiment. As shown in FIG. 7, a third buffering area is provided between the heating zone and the cooling zone, and the flux collection unit 53 and others are provided. In addition to the outlet of the reflow furnace, the mechanism to prevent the ambient gas from moving between zones as same as that of the fourth embodiment is provided between the heating chamber and the cooling chamber in which the temperature of the ambient gas is lowered.

When the third buffering area is provided between the heating chamber and the cooling chamber, the ambient gas is prevented from moving between the heating zone and the cooling zone, and the flux may be effectively removed.

In this embodiment, it is necessary to prevent flux from being liquefied and dropping. The ambient gas suction device and the flux dropping-prevention mechanism as described in the first to third embodiments may be provided to prevent flux from being liquefied and dropping.

Since the constructions in the above first, fourth and fifth embodiments are separate, each of those constructions may be used separately, or two or three of those constructions are combined and used. For example, the first and second buffering areas maybe provided between the inlet and the preheating chamber, as well as between the cooling chamber and the outlet, respectively.

EXPERIMENTAL RESULT

The test is carried out to acknowledge the effect of the present invention to maintain the oxygen concentration within the furnace, preventing the outside air from entering into the furnace The test is carried out to measure the variation of the oxygen concentration in the furnace with the use of the reflow furnace as shown in FIG. 1, in which a plurality of printed circuit boards are actually carried.

The temperature of each of the preheating chamber is set to be within a range from 140 to 175 degree Celsius. The temperature of each of the peak heating chamber is set to be within a range from 195 to 238 degree Celsius. The first buffering area is provided between the inlet labyrinth and the first preheating chamber, and the ambient gas is blown upward from the lower side of the carrier device in the area. Two types of circulation fans, i.e., strong (40 Hz) and weak (20 Hz) to blow the ambient gas are provided and the results thereof are compared.

Figure 8:
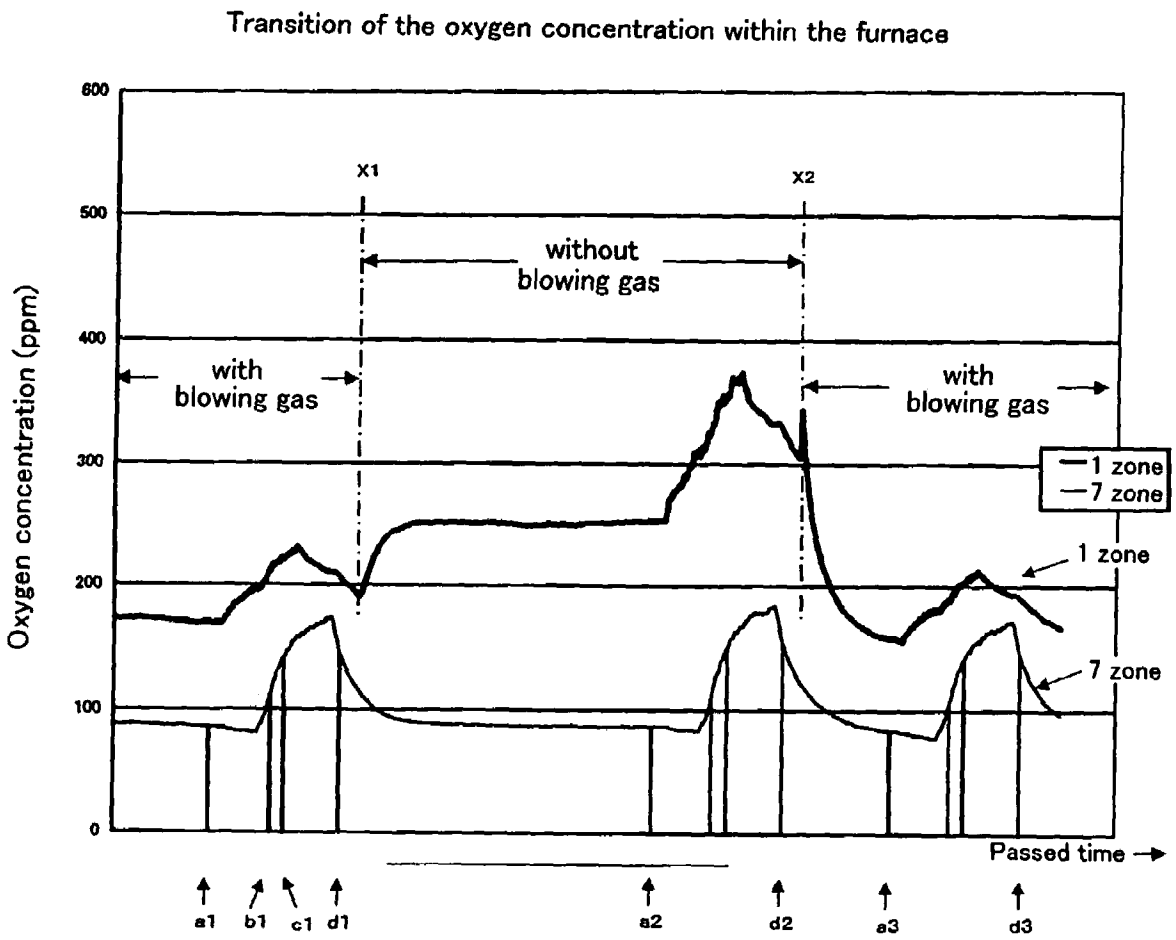
FIG. 8 is a graph showing an effect of the experiment result of the present invention.
Figure 9:
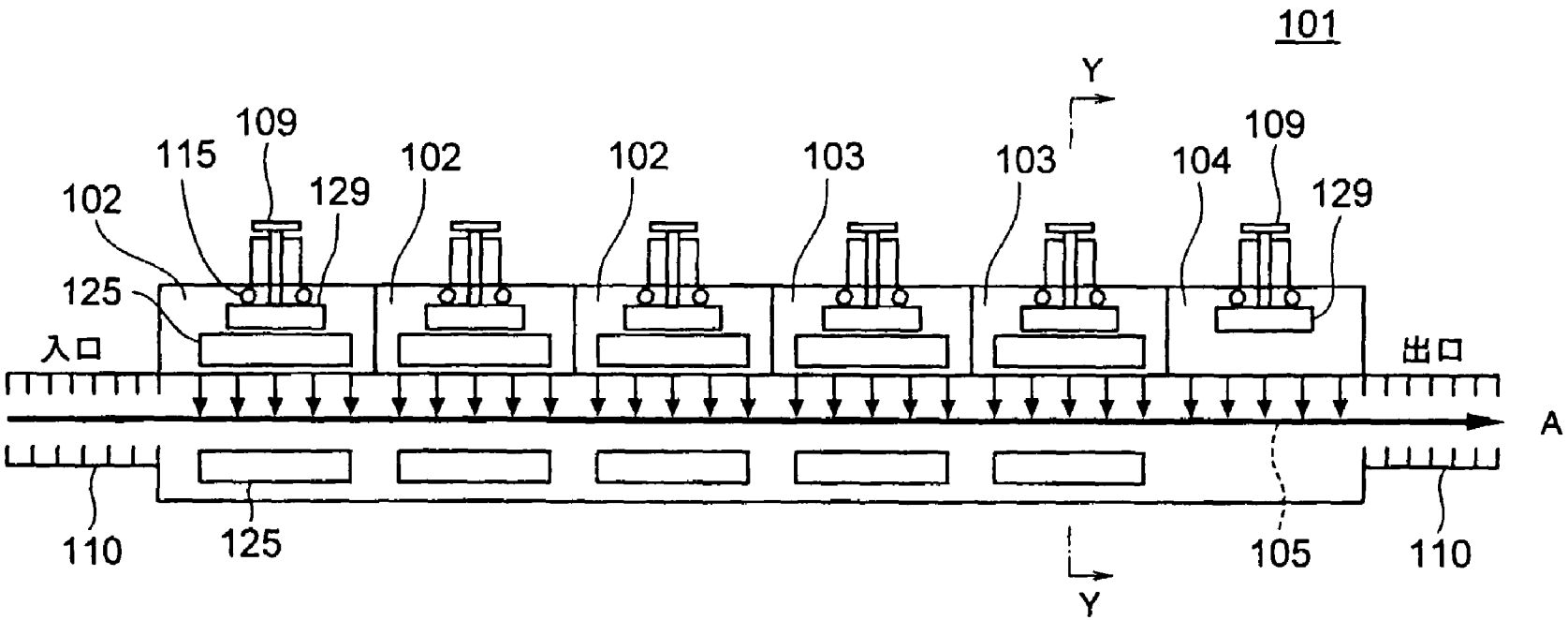
FIG. 9 is an overall view showing a reflow furnace according to the conventional art.

FIG. 8 shows the result of the experiment. The oxygen concentration within the heating zone (unit:ppm) is depicted in the vertical axis, and the passing time is depicted in the lateral axis. The thick line in the graph shows the oxygen concentration in the first zone, namely the first preheating chamber. The thin line shows the oxygen concentration in the seventh zone, namely the last heating chamber (prior to the cooling zone).

The time axis al shows the time when the first printed circuit board is carried in through the inlet. The b1 shows the time when the printed circuit board is carried out of the outlet. The c1 shows the time when the last printed circuit board is carried in through the inlet. The d1 shows the time when the printed circuit board is carried out of the outlet.

After the first printed circuit board is carried in the furnace (a1), the oxygen concentration in the preheating chamber (first zone) rises by the outside air entering from the inlet. The plurality of the printed circuit boards sequentially are carried into the furnace to raise the oxygen concentration in the first zone and the seventh zone. When the last printed circuit board is carried out of the furnace at d1, the oxygen concentration in the zone is lowered.

During the time that the plurality of the printed circuit boards are heated from a1 to d1, the ambient gas is blown in the first buffering area. The strength of the circulation fan was weak (20 Hz). It is depicted in the drawing as "gas blowing (weak)".

Then, the operation of the circulation fan was stopped (x1 in FIG. 8). After that, the same number of the printed circuit boards are carried in and heated from a2 to d2. The state that the circulation fan is stopped is depicted as "No gas blowing".

Again, the circulation fan is operated (x2 in FIG. 8). The strength of the circulation fan was strong (40 Hz). The same number of the printed circuit boards are carried in and heated from a3 to d3. The state that the circulation fan was operated strong is depicted as "gas blowing (strong)".

When the transitions of the oxygen concentration are investigated in the first zone and the seventh zone as the state of "gas blowing" and "No gas blowing", it becomes clear that the difference in the seventh zone is not so obvious, while the oxygen concentration largely changes in the first zone (the first preheating chamber). More specifically, when the gas is blown, the oxygen concentration in the first zone is below about 230 ppm. On the other hand, when the gas is not blown, the oxygen concentration in the same zone is raised up to 380 ppm. Furthermore, it becomes clear that the oxygen concentration in the first zone is different by the strength of the circulation fan.

It is acknowledged that the ambient gas blowing device of the present invention effectively functions to lower the oxygen concentration within the furnace.

According to the present invention, the ambient gas is blown upward from the lower side of the carrier device and the ambient gas is sucked above the carrier device in the buffering area provided respectively in the inlet, outlet of the furnace and the border portion between the heating zone and the cooling zone, thus it is possible to prevent outside air from entering, the ambient gas from moving zone through zone, and the ambient gas from flowing out.

Furthermore, according to the present invention, the ambient gas the temperature of which is lowered by the contact with the outside air is sucked from the suction device provided in the upper portion of the carrier device and introduced to the flux collection unit separately provided, and then the ambient gas is cooled by the heat exchanger or the like, thus the liquefied flux is collected.

According to the present invention, it is possible to prevent the flux from attaching to the printed circuit board, outside air from infiltrating through the inlet of the furnace, the ambient gas within the furnace from flowing out, and the oxygen concentration within the reflow furnace from being raised.

The present invention is not limited to the above described embodiments, and various variations and modifications may be possible without departing from the scope of the present invention.

This application is based on the Japanese Patent Application No. 2005-192709 filed on Jun. 30, 2005, entire content of which is expressly incorporated by reference herein.

What is claimed is:

1. A reflow furnace comprising:

a plurality of heating chambers to heat by blowing a heated ambient gas to a printed circuit boards carried within the furnace by a carrier device;

a cooling chamber provided next to said heating chamber to cool said printed circuit boards;

a first buffering area provided between said heating chamber and an inlet of the reflow furnace;

a blowing device to blow the ambient gas from a lower side of the carrier device to an upper side thereof in said first buffering area;

a suction device with a flux dropping-prevention mechanism to suck the ambient gas above the carrier device in said first buffering area; and a flux collection unit to remove the flux from the sucked ambient gas.

2. The reflow furnace according to claim 1, which further comprises:

a second buffering area provided between said cooling chamber and said outlet of the reflow furnace;

a blowing device to blow the ambient gas from a lower side of the carrier device to an upper side thereof in said second buffering area;

a suction device with a flux dropping-prevention mechanism to suck the ambient gas above the carrier device in said second buffering area; and a flux collection unit to remove the flux from the sucked ambient gas.

3. The reflow furnace according to claim 2, which further comprises:

a third buffering area provided between said heating chamber and said cooling chamber;

a blowing device to blow the ambient gas from a lower side of the carrier device to an upper side thereof in said third buffering area;

a suction device with a flux dropping-prevention mechanism to suck the ambient gas above the carrier device in said third buffering area; and a flux collection unit to remove the flux from the sucked ambient gas.

4. The reflow furnace according to claim 1, which further comprises:

a third buffering area provided between said heating chamber and said cooling chamber;

a blowing device to blow the ambient gas from a lower side of the carrier device to an upper side thereof in said third buffering area;

a suction device with a flux dropping-prevention mechanism to suck the ambient gas above the carrier device in said third buffering area; and a flux collection unit to remove the flux from the sucked ambient gas.

5. The reflow furnace according to claim 1, wherein said flux dropping-prevention mechanism includes a umbrella-shaped cover portion and a trough portion provided at a lower portion of an inner wall of said cover portion.

6. The reflow furnace according to claim 1, wherein said flux dropping-prevention mechanism includes an umbrella-shaped cover portion and a flocculent flux adsorption plate provided at a lower portion of an inner wall of said cover portion.

7. The reflow furnace according to claim 1, wherein said flux dropping-prevention mechanism includes a heater and a mesh plate heated by said heater.

8. The reflow furnace according to claim 1, wherein said flux collection unit includes a circulation fan, an outside air fan, a heat exchanger, and a liquefied flux collection tank.

9. The reflow furnace according to claim 1, which further includes a labyrinth provided at an inlet or outlet thereof.

10. The reflow furnace according to claim 1, wherein said ambient gas comprises an inert gas, and said ambient gas is filled within the reflow furnace.

11. A reflow furnace comprising:

a plurality of heating chambers to heat by blowing a heated ambient gas to a printed circuit boards carried within the furnace by a carrier device;

a cooling chamber provided next to said heating chamber to cool said printed circuit boards;

a buffering area provided between said cooling chamber and an outlet of the reflow furnace;

a blowing device to blow the ambient gas from a lower side of the carrier device to an upper side thereof in said buffering area;

a suction device with a flux dropping-prevention mechanism to suck the ambient gas above the carrier device in said buffering area; and a flux collection unit to remove the flux from the sucked ambient gas.

12. A reflow furnace comprising:

a plurality of heating chambers to heat by blowing a heated ambient gas to a printed circuit boards carried within the furnace by a carrier device;

a cooling chamber provided next to said heating chamber to cool said printed circuit boards;

a buffering area provided between said heating chamber and said cooling chamber;

a blowing device to blow the ambient gas from a lower side of the carrier device to an upper side thereof in said buffering area;

a suction device with a flux dropping-prevention mechanism to suck the ambient gas above the carrier device in said buffering area; and a flux collection unit to remove the flux from the sucked ambient gas.

* * * * *